US007554253B2

(12) United States Patent
Koyama et al.

(10) Patent No.: US 7,554,253 B2
(45) Date of Patent: Jun. 30, 2009

(54) SPARK PLUG WITH INCREASED DURABILITY AND CARBON FOULING RESISTANCE

(75) Inventors: Taiji Koyama, Toyohashi (JP); Keiji Kanao, Aichi-ken (JP)

(73) Assignee: Denso Corporation, Kariya (JP)

( * ) Notice: Subject to any disclaimer, the term of this patent is extended or adjusted under 35 U.S.C. 154(b) by 206 days.

(21) Appl. No.: 11/223,930

(22) Filed: Sep. 13, 2005

(65) Prior Publication Data

US 2006/0055299 A1 Mar. 16, 2006

(30) Foreign Application Priority Data

Sep. 14, 2004 (JP) ..... 2004-267097
May 9, 2005 (JP) ..... 2005-136162

(51) Int. Cl.
*H01T 13/20* (2006.01)
*H01T 21/02* (2006.01)
*H01T 13/00* (2006.01)

(52) U.S. Cl. ..... 313/141; 313/137; 445/7; 269/12

(58) Field of Classification Search ..... 313/135, 313/140–142
See application file for complete search history.

(56) References Cited

U.S. PATENT DOCUMENTS 3,870,918 A * 3/1975 Senda et al. ..... 313/131 R
4,092,558 A * 5/1978 Yamada ..... 313/131 R
5,693,999 A * 12/1997 Osamura et al. ..... 313/141
5,929,556 A * 7/1999 Matsubara et al. ..... 313/141
6,064,143 A * 5/2000 Kagawa ..... 313/141
6,091,185 A * 7/2000 Matsubara et al. ..... 313/138
6,095,124 A 8/2000 Matsubara et al.
6,316,868 B1 11/2001 Ishino et al.
6,552,476 B1 4/2003 Hanashi et al.

(Continued)

FOREIGN PATENT DOCUMENTS

JP A-UM-S52-131528 10/1977

(Continued)

OTHER PUBLICATIONS

Information Offer Form dated May 14, 2008 submitted in counterpart Japanese Application 2005-136162 with English translation.

(Continued)

*Primary Examiner*—Sikha Roy
*Assistant Examiner*—Tracie Y Green
(74) *Attorney, Agent, or Firm*—Nixon & Vanderhye, PC

(57) ABSTRACT

A spark plug for an internal combustion engine is provided which includes a metal shell, a porcelain insulator, a center electrode, a main ground electrode, and auxiliary ground electrodes. Each of the auxiliary ground electrodes has an end face facing the insulator to define an auxiliary spark gap. The end face includes an increasing-radial distance surface which is located at a distance from a longitudinal center line of the spark plug in a radial direction thereof which increases as approaching to the metal shell. The insulator nose has a wall thickness T meeting a relation of 0.3 mm≦T≦0.7 mm. This avoids a great local increase in electrical field strength on the auxiliary ground electrode to minimize excessive discharge within the auxiliary spark gap to enhance carbon fouling resistance and durability of the spark plug.

12 Claims, 14 Drawing Sheets

U.S. PATENT DOCUMENTS

| | | | | |
|---|---|---|---|---|
| 6,831,397 | B2 | 12/2004 | Kanao et al. | |
| 2002/0067110 | A1* | 6/2002 | Nishikawa et al. | 313/118 |
| 2002/0094743 | A1* | 7/2002 | Harada | 445/7 |
| 2002/0109447 | A1* | 8/2002 | Hanashi et al. | 313/123 |
| 2003/0062815 | A1* | 4/2003 | Kanao et al. | 313/141 |
| 2004/0080252 | A1 | 4/2004 | Ito et al. | |

FOREIGN PATENT DOCUMENTS

| | | |
|---|---|---|
| JP | 6-260261 | 9/1994 |
| JP | H11-135229 | 5/1999 |
| JP | 3140006 | 12/2000 |
| JP | A-2001-068251 | 3/2001 |
| JP | 2001-093645 | 4/2001 |
| JP | 2001-160475 | 6/2001 |
| JP | 2002-313524 | 10/2002 |
| JP | 2004-200137 | 7/2004 |

OTHER PUBLICATIONS

Japanese Office Action, dated Aug. 26, 2008, issued in corresponding Japanese Application No. 2005-136162 with English translation.

* cited by examiner

SPARK PLUG WITH INCREASED DURABILITY AND CARBON FOULING RESISTANCE

CROSS REFERENCE TO RELATED DOCUMENT

The present application claims the benefits of Japanese Patent Application No. 2004-267097 filed on Sep. 14, 2004 and Japanese Patent Application No. 2005-136162 filed May 9, 2005, disclosures of which are totally incorporated herein by reference.

BACKGROUND OF THE INVENTION

1. Technical Field of the Invention

The present invention relates generally to a spark plug with increased durability and carbon fouling resistance for internal combustion engines which may be used in automotive vehicles, co-generation systems, or gas feed pumps.

2. Background Art

Japanese Patent No. 3140006 (U.S. Pat. No. 6,229,253 B1) teaches a multi-ground electrode spark plug for internal combustion engines. FIG. 22 shows a multi-ground electrode spark plug 9 of the same type.

The spark plug 9 includes a porcelain insulator 92, a center electrode 93 retained within the porcelain insulator 92, a metal shell 94 in which the porcelain insulator 92 is retained with an insulator head 921 exposed outside the metal shell 94, and a main ground electrode 951 defining a main spark gap 911 between itself and a tip 931 of the center electrode 93.

When the combustion temperature is extremely low in the engine, so that the temperature of the surface of the porcelain insulator 92 is hardly increased, it may cause the engine to smolder, so that a layer of carbon is deposited on the porcelain insulator 92, thereby resulting in a drop in insulation resistance between the center electrode 93 and the metal shell 94, which, in the worst case, leads to misfiring of the engine.

In order to avoid the above problem, the spark plug 9 also includes auxiliary ground electrodes 952 which are welded to the metal shell 94 and face the side surface of the center electrode 93 through the insulator nose 921 to define auxiliary spark gaps 912. When the carbon is deposited on the porcelain insulator 92, so that the insulation resistance between the center electrode 93 and the metal shell 94 drops, sparks are produced within the auxiliary spark gaps 912 to burn off the carbon deposit to clean up the surface of the porcelain insulator 92.

The spark plug 9 is so designed as to induce discharge of sparks in the auxiliary spark gaps 912 only when the engine is smoldering, so that a layer of carbon is deposited on the porcelain insulator 92 and to discharge sparks mostly in the main spark gap, thereby eliminating channeling (i.e., formation of channels, as illustrated in FIGS. 10 and 11, in the surface of the porcelain insulator 92 caused by the discharge of sparks in the auxiliary spark gaps 912) and minimizing the wear of the center electrode 93, as illustrated in FIG. 8, to enhance anti-fouling characteristics (i.e., carbon fouling resistance) and service life of the spark plug 9.

However, in modern internal combustion engines, an increase in compression ratio, supercharging, lean-burning, or an increase in amount of EGR results in an increased flow velocity of mixture within combustion chambers of the engine, which biases sparks toward the auxiliary spark gaps 912 to increase the rate of occurrence of sparks in the auxiliary spark gaps 912. This causes sparks to be discharged within the auxiliary spark gaps 912 even when the engine is not smoldering, thus accelerating the channeling and wear of the center electrode 93, which leads to a greatly decrease in service life of the spark plug 9.

Each of the auxiliary ground electrodes 952 structurally induces a strong electrical field at an edge 954 of an end face 953 closer to the metal shell 94, which may cause sparks to be discharged in the auxiliary spark gap 912 frequently when the porcelain insulator 92 is not fouled with carbon, thus accelerating the channeling and the wear of the center electrode 93.

The auxiliary ground electrode 952 may be shaped not to induce the strong electrical field. This, however, results in a decrease in spark in the auxiliary spark gaps 912 when the engine is smoldering, thus giving rise to a deterioration of carbon fouling resistance of the spark plug 9.

SUMMARY OF THE INVENTION

It is therefore a principal object of the invention to avoid the disadvantages of the prior art.

It is another object of the invention to provide an improved structure of a spark plug for internal combustion engines which is designed to have an enhanced carbon fouling resistance and durability.

According to one aspect of the invention, there is provided a spark plug for an internal combustion engine which comprises: (a) a metal shell having a base end and a top end opposed to the base end in a longitudinal direction of the spark plug; (b) a hollow porcelain insulator having a length which includes a body and an insulator nose, the body being retained within the metal shell, the insulator nose projecting from the top end of the metal shell; (c) a center electrode retained within the porcelain insulator to have a top end protruding from the insulator nose; (d) a main ground electrode which defines a main spark gap between itself and the center electrode; and (e) an auxiliary ground electrode having a base end and a top end opposed to the base end. The base end is joined to the metal shell to define an auxiliary spark gap between the top end and a periphery of the porcelain insulator. The top end has an end face facing a longitudinal center line of the spark plug. The end face of the auxiliary ground electrode includes an increasing-radial distance surface which has a base edge closer to the base end of the auxiliary ground electrode and a top edge far from the base end of the auxiliary ground electrode and is located at a distance from the longitudinal center line of the spark plug in a radial direction of the spark plug which increases as approaching to the base edge from the top edge. The insulator nose of the porcelain insulator has a wall thickness T meeting a relation of 0.3 mm$\leqq$T$\leqq$0.7 mm.

The increasing-radial distance surface works to avoid a great local increase in electrical field strength on the auxiliary ground electrode to minimize excessive discharge within the auxiliary spark gap. Specifically, when the engine is not smoldering, the discharge of sparks within the auxiliary spark gaps are avoided. This minimizes the channeling or the wear of the center electrode.

The wall thickness T of the insulator nose which is within a range of 0.7 mm or less serves to minimize an area of the porcelain insulator on which carbon will be deposited, thereby enhancing the carbon fouling resistance of the spark plug. Specifically, the formation of the increasing-radial distance surface results in a decrease in frequency of sparks therewithin, but serves to meet a requirement to burn off carbon deposit through the sparks, thereby ensuring the carbon fouling resistance.

The wall thickness T of the insulator nose is also 0.3 mm or more, thereby ensuring desired mechanical strength of the porcelain insulator to minimize breakage of or cracks in the porcelain insulator during production thereof.

In the preferred mode of the invention, the increasing-radial distance surface may be designed to taper toward the top edge thereof to have widths of 0.3 mm or more in a radius direction and the longitudinal direction of the spark plug. This shape of the increasing-radial distance surface further minimizes sparks discharged within the auxiliary spark gap when the engine is not smoldering to prolong the service life of the spark plug.

The increasing-radial distance surface may alternatively be rounded to have a radius of curvature of 0.3 mm or more. This shape of the increasing-radial distance surface, like the above, further minimizes sparks discharged within the auxiliary spark gap when the engine is not smoldering to prolong the service life of the spark plug.

A distance A between the top end of the metal shell and a top end of the center electrode in the longitudinal direction of the spark plug, a distance B between the top end of the metal shell and a top end of the porcelain insulator in the longitudinal direction of the spark plug, and a distance C between the top end of the metal shell and a portion of the end face of the auxiliary ground electrode closest to the longitudinal center line of the spark plug are selected preferably to meet relations of $A-C \leqq 3$ mm and $-1.0$ mm$\leqq B-C \leqq 1.5$ mm. This enhances the ignition of an air-fuel mixture in the engine by sparks generated in the auxiliary spark gap. Usually, the deeper the auxiliary spark gap are located in the combustion chamber of the engine, the better the ignition of the mixture by the sparks within the auxiliary spark gap will be. The dimensional relation of $A-C \leqq 3$ mm enables the auxiliary spark gap to be located deep inside the combustion chamber of the engine to enhance the ignitability of the mixture.

The dimensional relation of $-1.0$ mm$\leqq B-C \leqq 1.5$ mm also enables the auxiliary ground electrodes to be located close to the top end of the porcelain insulator, thus facilitating burning off of carbon deposits on the top end where they will be most objectionable in operation of the spark plug, which improves the carbon fouling resistance of the spark plug.

The end face of the auxiliary ground electrode may also include a constant-radial distance surface which extends farther from the top end of the metal shell than the increasing-radial distance surface in parallel to the longitudinal center line of the spark plug. The constant-radial distance surface works to decrease a local increase in electrical field strength on the auxiliary ground electrode to minimize excessive discharge within the auxiliary spark gap.

A width D of the constant-radial distance surface in the longitudinal direction of the spark plug may be selected to meet a relation of $D \geqq 0.3$ mm. This improves the wear resistance of the auxiliary ground electrode.

The distance A between the top end of the metal shell and a top end of the center electrode in the longitudinal direction of the spark plug, the distance B between the top end of the metal shell and a top end of the porcelain insulator in the longitudinal direction of the spark plug, and a distance E between the top end of the metal shell and a center of the constant-radial distance surface of the auxiliary ground electrode in the longitudinal direction of the spark plug are selected preferably to meet relations of $A-E \leqq 3$ mm and $-1.0$ mm$\leqq B-E \leqq 1.5$ mm. This facilitates the ignition of the air-fuel mixture in the engine by sparks generated in the auxiliary spark gap and improves the carbon fouling resistance of the spark plug.

Usually, the deeper the auxiliary spark gap are located in the combustion chamber of the engine, the better the ignition of the mixture by the sparks within the auxiliary spark gap will be. The dimensional relation of $A-E \leqq 3$ mm enables the auxiliary spark gap to be located deep inside the combustion chamber of the engine to enhance the ignitability of the mixture.

The dimensional relation of $-1.0$ mm$\leqq B-E \leqq 1.5$ mm also enables the auxiliary ground electrodes to be located close to the top end of the porcelain insulator, thus facilitating burning off of carbon deposits on the top end where they will be most objectionable in operation of the spark plug, which improves the carbon fouling resistance of the spark plug.

The main spark gap has a length X. The auxiliary spark gap has a length Y. The lengths X and Y are preferably selected to meet a relation of $X>Y$. This facilitates ease of discharge of sparks in the auxiliary spark gap when the engine is smoldering.

The lengths X and Y preferably meet relations of $X \leqq 0.9$ mm and 0.3 mm$\leqq Y \leqq X-0.1$ mm. This results in a decrease in voltage of electrical discharge in the main spark gap to enhance the voltage endurance of the porcelain insulator and the carbon fouling resistance of the spark plug.

The center electrode and the main ground electrode may have noble metal chips opposed to each other to define the main spark gap. The noble metal chip of the center electrode has a transverse sectional area of 0.07 $mm^2$ to 0.64 $mm^2$, as extends in a direction perpendicular to an axial direction of the spark plug, and a height of 0.3 mm to 1.5 mm, as extends in the axial direction of the spark plug. The noble metal chip of the main ground electrode has a transverse sectional area of 0.12 $mm^2$ to 0.80 $mm^2$, as extends in a direction perpendicular to the axial direction of the spark plug, and a height of 0.3 mm to 1.5 mm, as extends in the axial direction of the spark plug. This minimizes the wear of the noble metal chips to ensure a desired service life of the spark plug and enhances the ignition of fuel in the engine.

The metal shell has a thread which has a thread diameter of M12 or less. This permits the spark plug to be made suitable in size for modern internal combustion engines and increases the design freedom of the engines, thereby permitting the size of valves of the engine to be increased or an engine cooling system to be improved mechanically. The M12 diameter of the thread also allows the amount of bending of the auxiliary ground electrode to be decreased, thus resulting in ease of machining of the auxiliary ground electrode. This minimizes the wear of the noble metal chips to ensure a desired service life of the spark plug and enhances the ignition of fuel in the engine.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
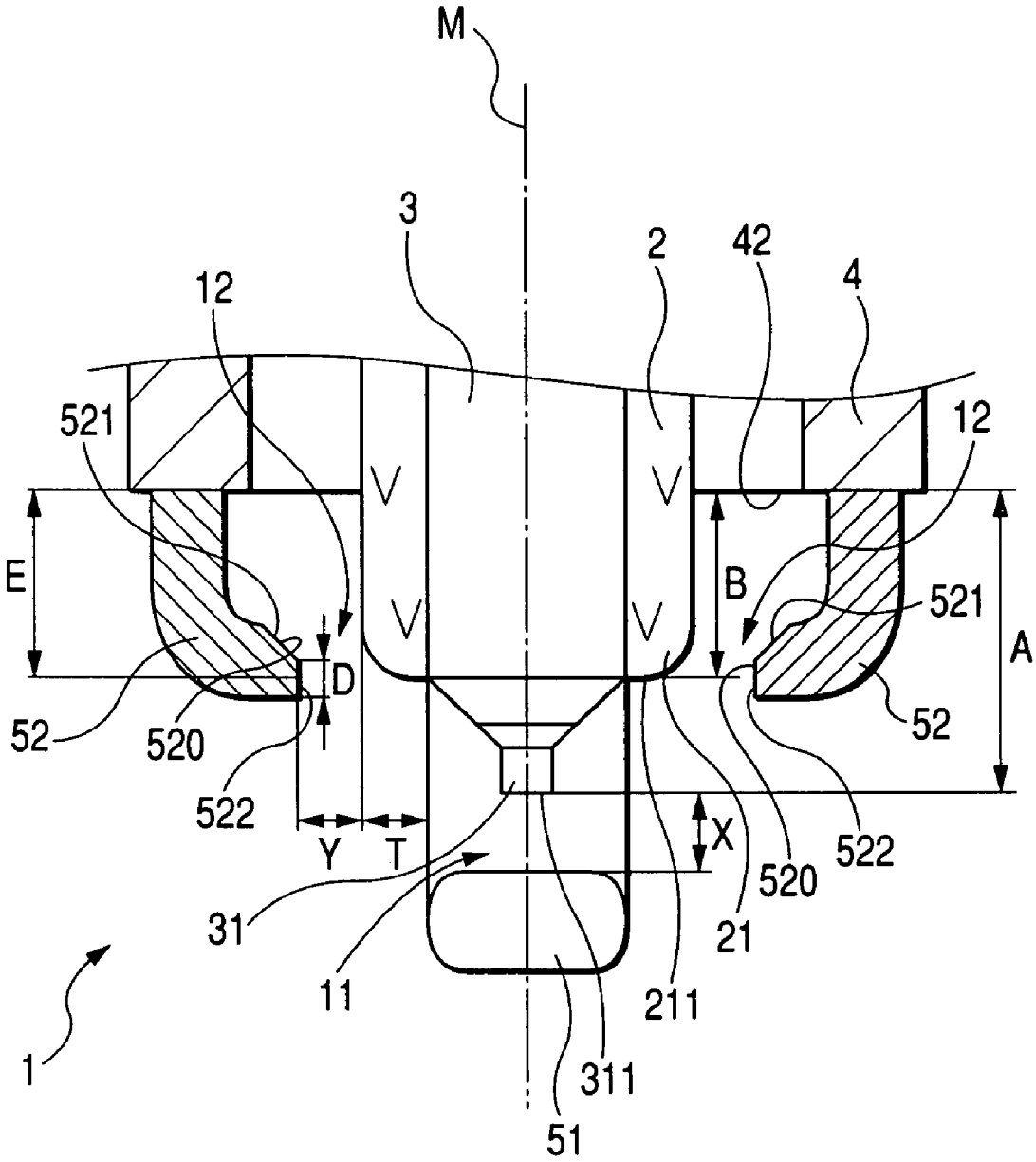
FIG. 1 is a partially longitudinal sectional view which shows a top portion of a spark plug according to the first embodiment of the invention.
Figure 2:
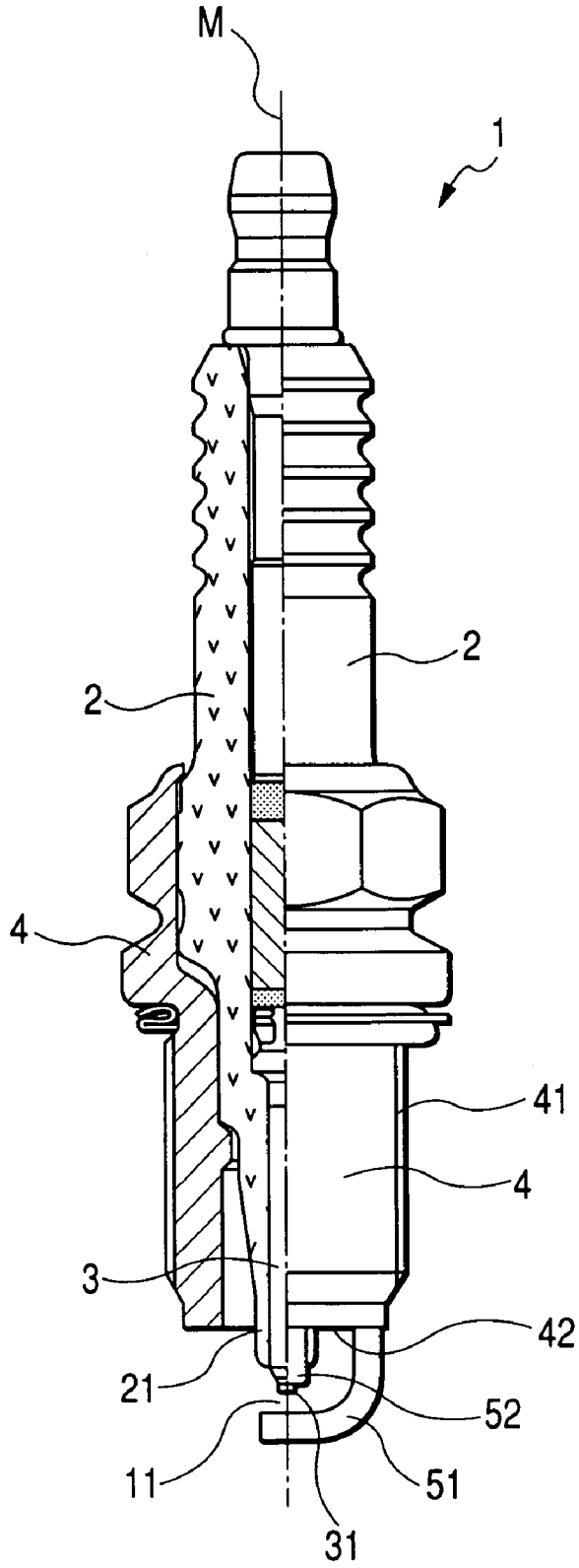
FIG. 2 is a partially sectional view which shows a spark plug according to the first embodiment of the invention.

Referring to the drawings, wherein like reference numbers refer to like parts in several views, particularly to FIGS. 1 and 2, there is shown a spark plug 1 for use in internal combustion engines according to the first embodiment of the invention.

The spark plug 1, as can be seen from FIG. 2, includes a hollow cylindrical metal shell 4, a porcelain insulator 2, and a center electrode 3. The metal shell 4 has formed on an outer periphery thereof a plug-installation thread 41 for installation of the spark plug 1 in the internal combustion engine. The porcelain insulator 2 is retained in the metal shell 4 to have a nose 21 projecting therefrom. The center electrode 3 is retained in the porcelain insulator 2 and has a tip 31 exposed outside the nose 21 of the porcelain insulator 2. The spark plug 1 also includes a main ground electrode 51 and auxiliary ground electrodes 52. The main ground electrode 51 is welded to the metal shell 4 and faces the tip 31 of the center electrode 3 to define a main spark gap 11. The auxiliary ground electrodes 52 are welded at base ends thereof to the metal shell 4 and define auxiliary spark gaps 12 between themselves and the insulator nose 21, respectively.

Each of the auxiliary ground electrodes 52, as clearly illustrated in FIG. 2, has an end face 520 facing a longitudinal center line M (i.e., an axis) of the spark plug 1 (i.e., the center electrode 3). The end face 520 is made up of an increasing-radial distance surface 521 and a constant-radial distance surface 522. The increasing-radial distance surface 521 is located at a distance from the longitudinal center line M that increases as approaching to the base end of the auxiliary ground electrode 52. In other words, the increasing-radial distance surface 521 forms a tip of the auxiliary ground electrode 52 which tapers toward the longitudinal center line M.

The insulator nose 21 has a wall thickness has a wall thickness T which meets a relation of $0.3\ \text{mm} \leqq T \leqq 0.7\ \text{mm}$.

Figure 3:
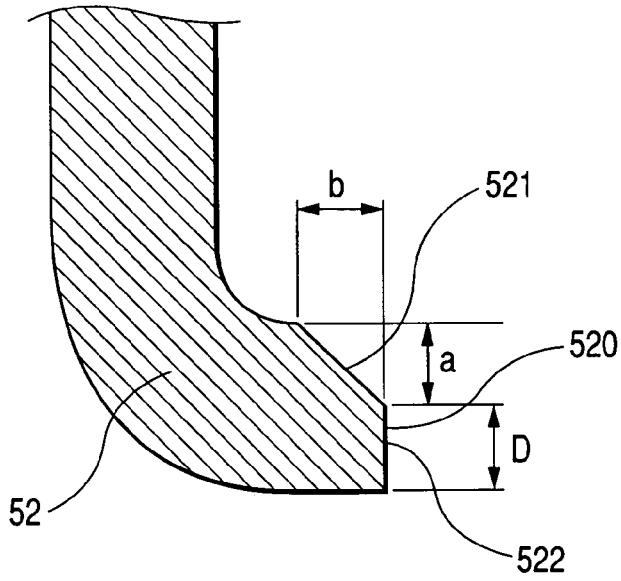
FIG. 3 is a partially longitudinal sectional view which shows a top portion of an auxiliary ground electrode of the spark plug of FIG. 2.

Each of the increasing-radial distance surfaces 521 has, as clearly illustrated in FIG. 3, a top edge and a base edge which are at a distance a of 0.3 mm from each other in a longitudinal direction of the spark plug 1 and at a distance b of 0.3 mm in a radial direction of the spark plug 1.

The constant-radial distance surface 522 of each of the auxiliary ground electrodes 52 is located at a constant distance from the longitudinal center line M. In other words, the constant-radial distance surface 522 extends parallel to the longitudinal center line M.

The constant-radial distance surface 522 has a distance D (i.e., the width) in a direction of the longitudinal center line M which meets a relation of $D \geqq 0.3\ \text{mm}$.

Referring back to FIG. 1, if the distance between the top end 42 of the metal shell 4 and the tip end 311 of the center electrode 3 in the longitudinal direction of the spark plug 1 is defined as A, the distance between the top end 42 and the top end 211 of the porcelain insulator 2 in the longitudinal direction of the spark plug 1 is defined as B, and the distance between the top end 42 and the center of the constant-radial distance surface 522 in the longitudinal direction of the spark plug 1 is defined as E, they are selected to meet relations of $A-E \leqq 3\ \text{mm}$ and $-1.0\ \text{mm} \leqq B-E \leqq 1.5\ \text{mm}$.

If the size of main spark gap 11, that is, the distance between the tip 31 of the center electrode 3 and the main ground electrode 51 is defined as X, and the distance of the auxiliary spark gaps 12 is defined as Y, they meet a relation of $X>Y$. The distances X and Y also satisfy relations of $X \leqq 0.9$ mm and $0.3\ \text{mm} \leqq Y \leqq X-0.1\ \text{mm}$.

The thread 41 of the metal shell 4 has a thread diameter M12 (i.e., 12 mm) or less.

Figure 4:
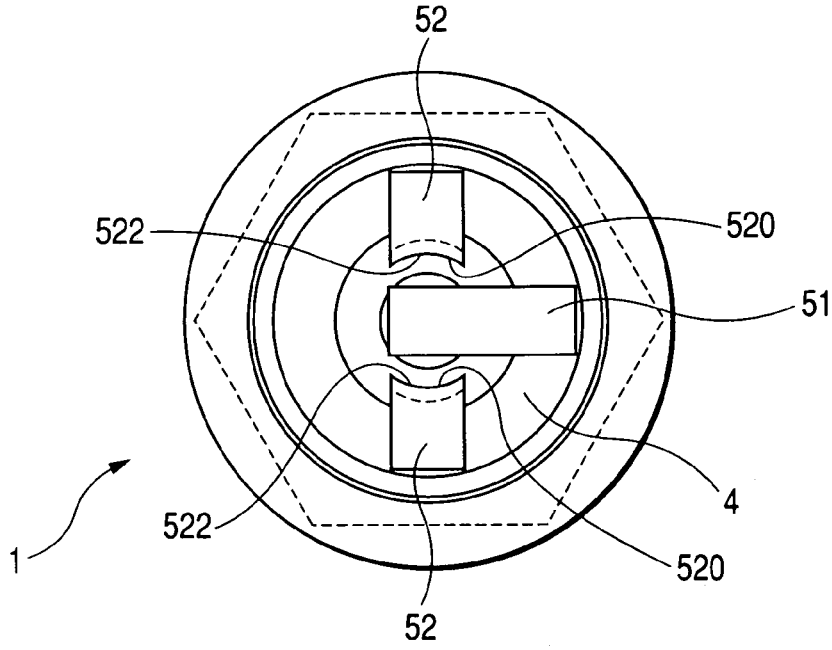
FIG. 4 is a top view which shows the spark plug of FIG. 2.

The two auxiliary ground electrodes 51 are, as can be seen from FIGS. 1 and 4, welded to the metal shell 4 and opposed diametrically to each other across the center electrode 3. The end face 502 of each of the auxiliary ground electrodes 52 is, as can be seen from FIG. 4, curved to have an arc shape. Specifically, the end face 502 extends a circumferential direction of the spark plug 1 along a circle, as defined coaxially with the center electrode 3.

Only one or more than two auxiliary ground electrodes may alternatively be installed on the metal shell 4. The geometry of the auxiliary ground electrodes 52 is not limited to the illustrated one.

The beneficial advantages of the spark plug 1 will be described below.

The increasing radial distance surfaces 521 are, as described above, formed on the end faces 520 of the auxiliary ground electrodes 52, respectively, thereby avoiding a great local increase in electrical field strength on each of the auxiliary ground electrodes 52 to minimize excessive discharge within the auxiliary spark gap 12. Specifically, when the engine is not smoldering, the discharge within the auxiliary spark gaps 12 are avoided. This minimizes the channeling or the wear of the peripheral side wall of the center electrode 3.

The wall thickness T of the nose 21 of the porcelain insulator 2 is 0.7 mm or less, thereby minimizing an area of the porcelain insulator 21 on which carbon would be deposited, which enhances the carbon fouling resistance of the spark plug 1. Specifically, the increasing radial distance surfaces 521 of the auxiliary spark gaps 12 work to decrease the frequency of occurrence of sparks therewithin, but burn off the carbon deposits sufficiently using the sparks within the auxiliary spark gaps 12 to ensure the carbon fouling resistance.

The wall thickness T of the nose 21 of the porcelain insulator 2 is 0.3 mm or more, thereby ensuring desired mechanical strength of the porcelain insulator 2 to minimize breakage of or cracks in the porcelain insulator 2 during production thereof.

Each of the increasing radial distance surfaces 521 is, as clearly illustrated in FIG. 3, defined by a tapered surface having the longitudinal width a of 0.3 mm and the transverse width b of 0.3 mm, thereby minimizing sparks in the auxiliary spark gaps 12 when the engine is not smoldering, which avoids the channeling or the wear of the peripheral side wall of the center electrode 3.

The distance A between the top end 42 of the metal shell 4 and the tip end 311 of the center electrode 3 in the longitudinal direction of the spark plug 1, the distance B between the top end 42 and the top end 211 of the porcelain insulator 2 in the longitudinal direction of the spark plug 1, and the distance E between the top end 42 and the center of the constant-radial distance surface 522 in the longitudinal direction of the spark plug 1 are, as described above, selected to meet the relations of $A-E \leqq 3$ mm and $-1.0$ mm $\leqq B-E \leqq 1.5$ mm, thereby ensuring the ignitability of fuel in the auxiliary spark gaps 12 and improves the carbon fouling resistance of the spark plug 1.

Usually, the deeper the auxiliary spark gaps 12 are located in the combustion chamber of the engine, the better the ignition of the mixture by the sparks within the auxiliary spark gaps 12 will be. The selection of the distance E between the top end 42 and the center of the constant-radial distance surface 522 within a range of $A-E \leqq 3$ mm ensures a desired reach (i.e., the distance the spark plug 1 extends into the combustion chamber) of the spark plug 1 to locate the auxiliary spark gaps 12 deep inside the combustion chamber of the engine to enhance the ignitability of the fuel. The selection of the distance E within a range of $-1.0$ mm $\leqq B-E \leqq 1.5$ mm enables the auxiliary ground electrodes 52 to be located close to the top end 211 of the porcelain insulator 2, thus facilitating burning off of carbon deposits on the top end 211 where they will be most objectionable in operation of the spark plug 1, which improves the carbon fouling resistance of the spark plug 1.

The distance X of the main spark gap 11 and the distance Y of the auxiliary spark gaps 12 are selected to meet the relation of $X>Y$, thereby facilitating discharge of sparks within the auxiliary spark gaps 12 when the engine is smoldering to enhance the carbon fouling resistance of the spark plug 1.

The distances X and Y are also selected to satisfy relations of $X \leqq 0.9$ mm and 0.3 mm $\leqq Y \leqq X-0.1$ mm, thereby decreasing the voltage of electrical discharge in the main spark gap 11 to enhance the voltage endurance of the porcelain insulator 2 and the carbon fouling resistance of the spark plug 1.

The width D of the constant-radial distance surface 522 in the direction of the longitudinal center line M is selected within a range of $D \geqq 0.3$ mm, thereby ensuring the wear resistance of the auxiliary ground electrodes 52.

The diameter of the thread 41 of the metal shell 4 is M12 (i.e., 12 mm) or less, thereby permitting the spark plug 1 to be made suitable in size for internal combustion engines. This increases the design freedom of internal combustion engines, thereby permitting the size of valves of the engine to be increased or an engine cooling system to be improved mechanically.

Figure 5:
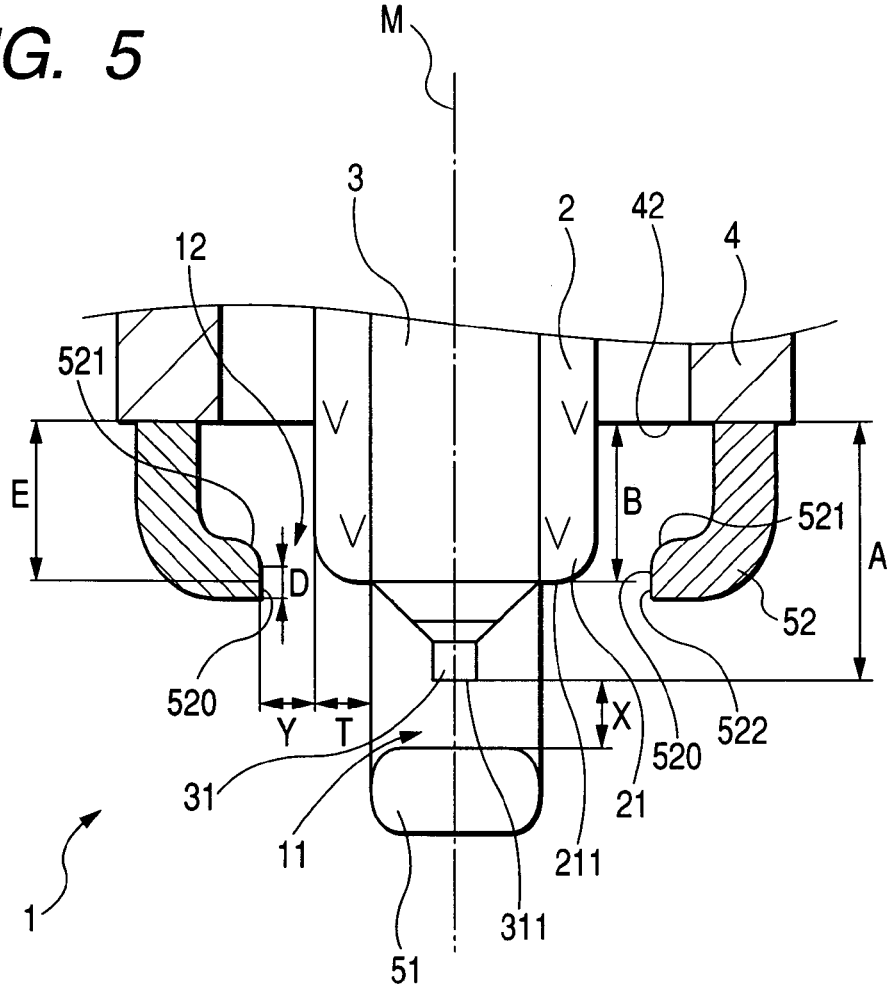
FIG. 5 is a partially longitudinal sectional view which shows a top portion of a spark plug according to the second embodiment of the invention.
Figure 6:
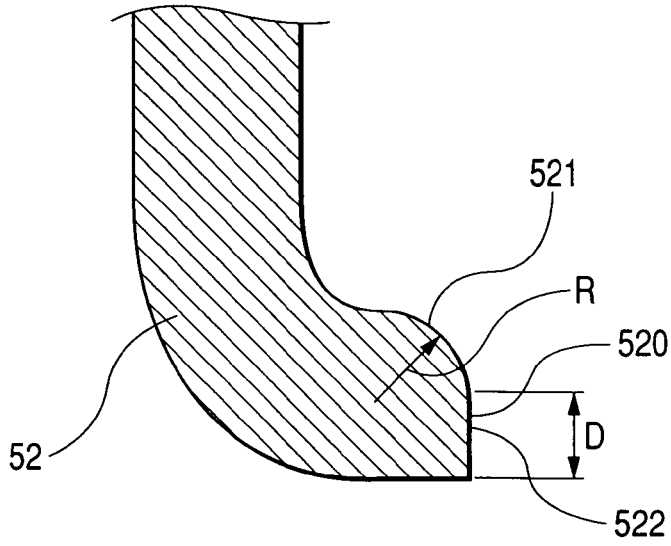
FIG. 6 is a partially longitudinal sectional view which shows a top portion of an auxiliary ground electrode of the spark plug of FIG. 5.

FIGS. 5 and 6 illustrate the spark plug 1 according to the second embodiment of the invention in which each of the increasing-radial distance surfaces 521 is defined by a curved corner of the end face 520 which is closer to the top end 42 of the metal shell 4 and has a radius of curvature R of 0.3 mm or more.

Other arrangements are identical with those in the first embodiment, and explanation thereof in detail will be omitted here.

The structure of the spark plug 1 of this embodiment, like the first embodiment, works to avoid sparks in the auxiliary spark gaps 12 when the engine is not smoldering, thereby minimizing the channeling or the wear of the peripheral side wall of the center electrode 3.

Figure 7:
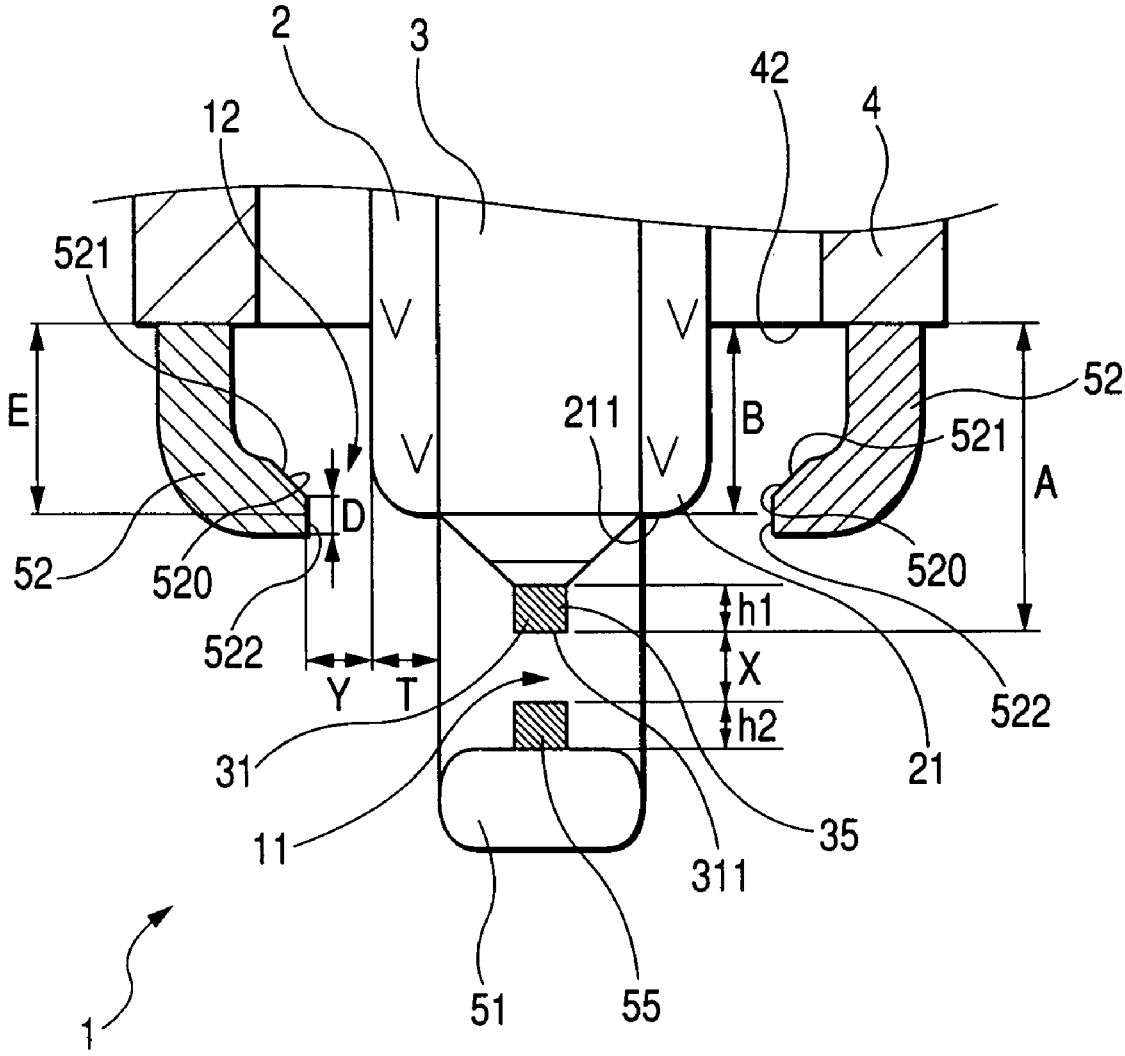
FIG. 7 is a partially longitudinal sectional view which shows a top portion of a spark plug according to the third embodiment of the invention.

FIG. 7 shows the spark plug 1 for internal combustion engines according to the third embodiment of the invention in which noble metal chips 35 and 55 are welded to the center electrode 3 and the main ground electrode 51 to define the main spark gap 11.

The noble metal chip 35 joined to the center electrode 3 has a transverse sectional area of 0.07 $mm^2$ to 0.64 $mm^2$ in a direction perpendicular to an axis thereof (i.e., the longitudinal center line M of the center electrode 3) and a height h1 of 0.3 mm to 1.5 mm in an axial direction thereof (i.e., the lengthwise direction of the center electrode 3). The noble metal chip 55 joined to the main ground electrode 51 has a transverse sectional area of 0.12 $mm^2$ to 0.80 $mm^2$ in a direction perpendicular to an axis thereof and a height h2 of 0.3 mm to 1.5 mm in an axial direction thereof.

The noble metal chip 35 defines the tip 31 of the center electrode 3. The main spark gap 11 is formed between the noble metal chips 35 and 55 and has the distance X, as described in the first embodiment.

The noble metal chip 35 is made from material which contains a main component of 50% or more by weight of Ir and at least one additive and has a melting point of 2000□ C. or more. The additive is selected from among Pt, Rh, Ni, W, Pd, Ru, Re, Al, $Al_2O_3$, Y, and $Y_2O_3$.

The noble metal chip 55 is made from material which contains a main component of 50% or more by weight of Pt and at least one additive and has a melting point of 1500□ C. or more. The additive is selected from among Pt, Rh, Ni, W, Pd, Ru, Re, Al, $Al_2O_3$, Y, and $Y_2O_3$.

Other arrangements are identical with those in the first embodiment, and explanation thereof in detail will be omitted here.

Figure 8:
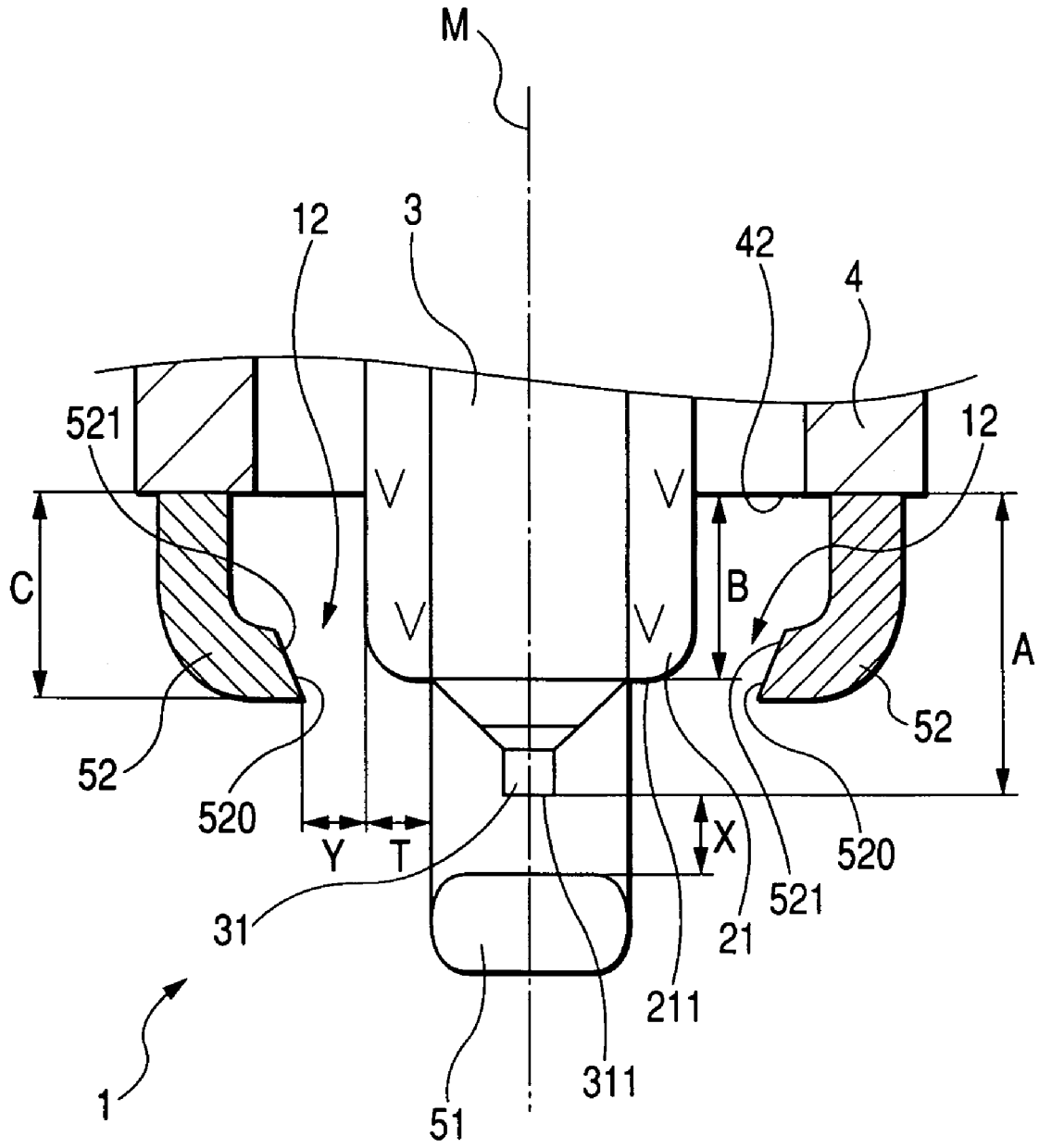
FIG. 8 is a partially longitudinal sectional view which shows a top portion of a spark plug according to the fourth embodiment of the invention.
Figure 9:
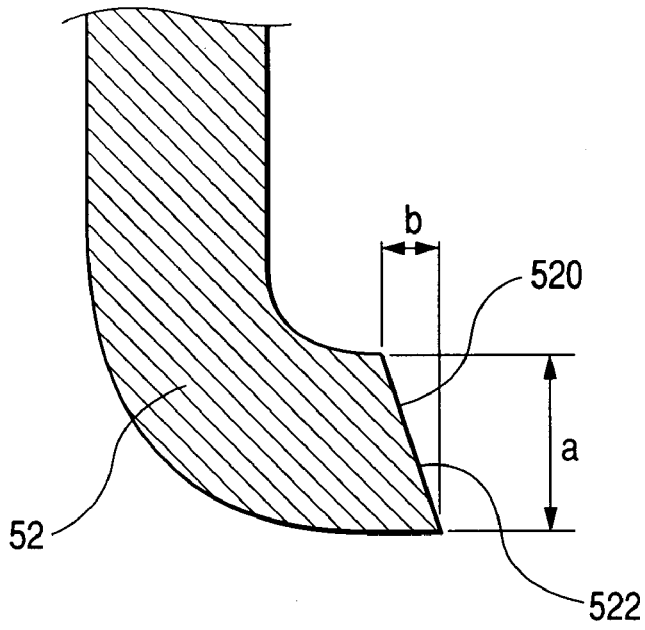
FIG. 9 is a partially longitudinal sectional view which shows a top portion of an auxiliary ground electrode of the spark plug of FIG. 8.

FIGS. 8 and 9 show the spark plug 1 according to the fourth embodiment of the invention in which the increasing-radial distance surfaces 521 occupy the whole of the end faces 520 of the auxiliary ground electrodes 52, respectively.

Specifically, each of the end faces 520 is tapered toward the top edge thereof to define one of the increasing-radial distance surfaces 521. Each of the increasing-radial distance surfaces 521 has, as clearly illustrated in FIG. 9, the top edge and the base edge which are at a distance a of 0.3 mm from each other in the longitudinal direction of the spark plug 1 and at a distance b of 0.3 mm in the radial direction of the spark plug 1.

The distance A between the top end 42 of the metal shell 4 and the tip end 311 of the center electrode 3 in the longitudinal direction of the spark plug 1, the distance B between the top end 42 and the top end 211 of the porcelain insulator 2 in the longitudinal direction of the spark plug 1, and the distance C between the top end 42 of the metal shell 4 and a portion (i.e., the top edge) of the end face 520 of each of the auxiliary ground electrodes 52 which is closest to the longitudinal center line M are selected to meet relations of $A-C \leqq 3$ mm and $-1.0$ mm$\leqq B-C \leqq 1.5$ mm. This ensures the ignitability of fuel in the auxiliary spark gaps 12 and improves the carbon fouling resistance of the spark plug 1.

Other arrangements are identical with those in the first embodiment, and explanation thereof in detail will be omitted here.

Figure 10:
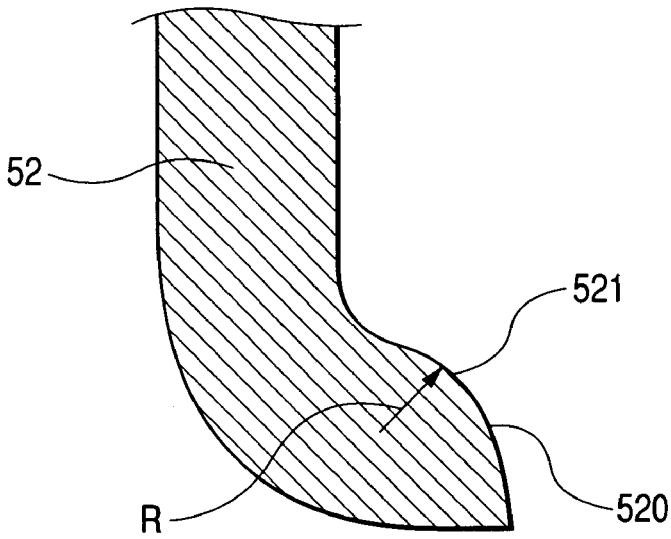
FIG. 10 is a partially longitudinal sectional view which shows a top portion of an auxiliary ground electrode of a spark plug according to the fifth embodiment of the invention.

FIG. 10 illustrates the auxiliary ground electrodes 52 (only one is shown for the brevity of illustration) of the spark plug 1 according to the fifth embodiment of the invention in which each of the increasing-radial distance surfaces 521 is curved and occupies the whole of one of the end faces 520 of the auxiliary ground electrodes 52.

The increasing-radial distance surfaces 521 each have a radius of curvature R of 0.3 mm or more.

Other arrangements are identical with those in the first embodiment, and explanation thereof in detail will be omitted here.

The structure of the spark plug 1 of this embodiment, like the first embodiment, works to avoid sparks in the auxiliary spark gaps 12 when the engine is not smoldering, thereby minimizing the channeling or the wear of the peripheral side wall of the center electrode 3.

Figure 11:
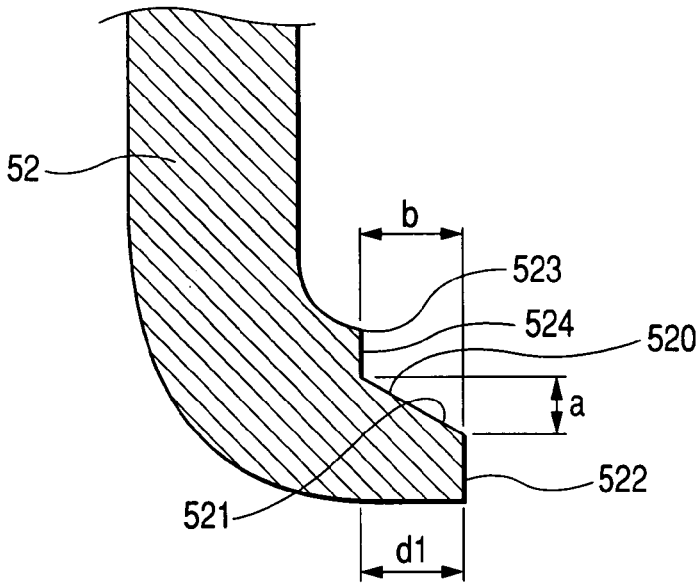
FIG. 11 is a partially longitudinal sectional view which shows a top portion of an auxiliary ground electrode of a spark plug according to the sixth embodiment of the invention.

FIG. 11 illustrates the auxiliary ground electrodes 52 (only one is shown for the brevity of illustration) of the spark plug 1 according to the sixth embodiment of the invention in which the end face 520 of the auxiliary ground electrode 52 includes an upright surface 524 to define an edged corner 523 (i.e., the base edge) closer to the top end of the metal shell 4.

Specifically, the end face 520 is made up of the increasing-radial distance surface 521, the constant-radial distance surface 522, and the upright surface 524. The upright surface 524 extends from an outside edge of the increasing-radial distance surface 521 and may be oriented parallel to the longitudinal center line M of the spark plug 1. The increasing-radial distance surface 521 is, like the first embodiment, flat. Other arrangements are identical with those in the first embodiment, and explanation thereof in detail will be omitted here.

Figure 12:
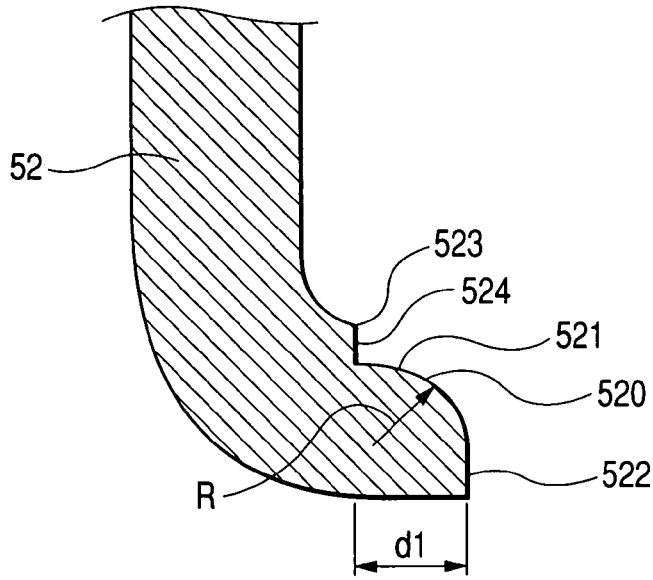
FIG. 12 is a partially longitudinal sectional view which shows a modified form of an auxiliary ground electrode of the spark plug of FIG. 11.

FIG. 12 shows a modification of the auxiliary ground electrode 52 of FIG. 11 in which the increasing-radial distance surface 521 of each of the auxiliary ground electrodes 52 is, like the second embodiment of FIGS. 5 and 6, curved to have the same radius of curvature. Other arrangements are identical with those in the sixth embodiment, and explanation thereof in detail will be omitted here.

The width d1 of the increasing-radial distance surface 521 of each of the auxiliary ground electrodes 52, as illustrated in FIGS. 11 and 12, in the direction perpendicular to the length of the spark plug 1 (i.e., the distance or interval between the constant-radial distance surface 522 and the corner 523 in the radius direction of the spark plug 1) is selected to be 0.5 mm or more. This avoids a local increase in electrical field strength on the corner 523, thereby minimizing the channeling or the wear of the peripheral side wall of the center electrode 3.

Figure 13:
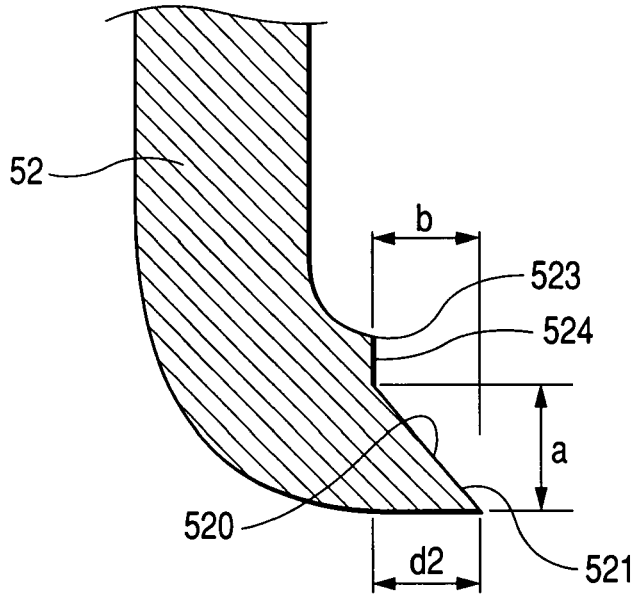
FIG. 13 is a partially longitudinal sectional view which shows a top portion of an auxiliary ground electrode of a spark plug according to the seventh embodiment of the invention.

FIG. 13 illustrates the auxiliary ground electrodes 52 (only one is shown for the brevity of illustration) of the spark plug 1 according to the seventh embodiment of the invention which is a combination of the ones, as illustrated in FIGS. 9 and 11.

Specifically, the end face 520 is made up of the tapered increasing-radial distance surface 521 and the upright surface 524 to have the edged corner 523. The upright surface 524 extends from an outside edge of the increasing-radial distance surface 521 and may be oriented parallel to the longitudinal center line M of the spark plug 1. The increasing-radial distance surface 521 is, like the fourth embodiment of FIGS. 8 and 9, flat.

Figure 14:
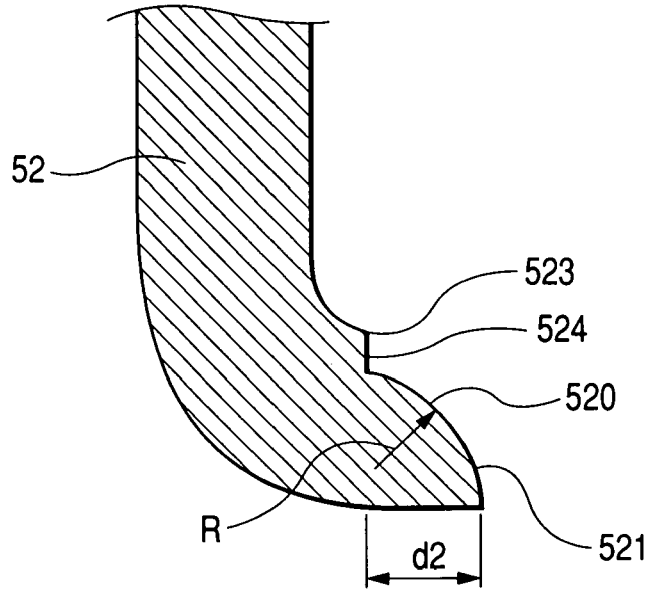
FIG. 14 is a partially longitudinal sectional view which shows a modified form of an auxiliary ground electrode of the spark plug of FIG. 13.

FIG. 14 shows the auxiliary ground electrode 52 of FIG. 13 in which the increasing-radial distance surface 521 of each of the auxiliary ground electrodes 52 is, like the fifth embodiment of FIG. 10, curved to have the radius of curvature R.

The width d2 of the increasing-radial distance surface 521 of each of the auxiliary ground electrodes 52, as illustrated in FIGS. 13 and 14, in the direction perpendicular to the length of the spark plug 1 (i.e., the distance or interval between the inside edge of the increasing-radial distance surface 521 and the corner 523 in the radius direction of the spark plug 1) is selected to be 0.5 mm or more. This avoids a local increase in electrical field strength on the corner 523, thereby minimizing the channeling or the wear of the peripheral side wall of the center electrode 3.

Experiment 1

We performed tests to evaluate the carbon fouling resistance of the spark plug 1 in terms of the thickness T of the nose 21 of the porcelain insulator 2.

Figure 22:
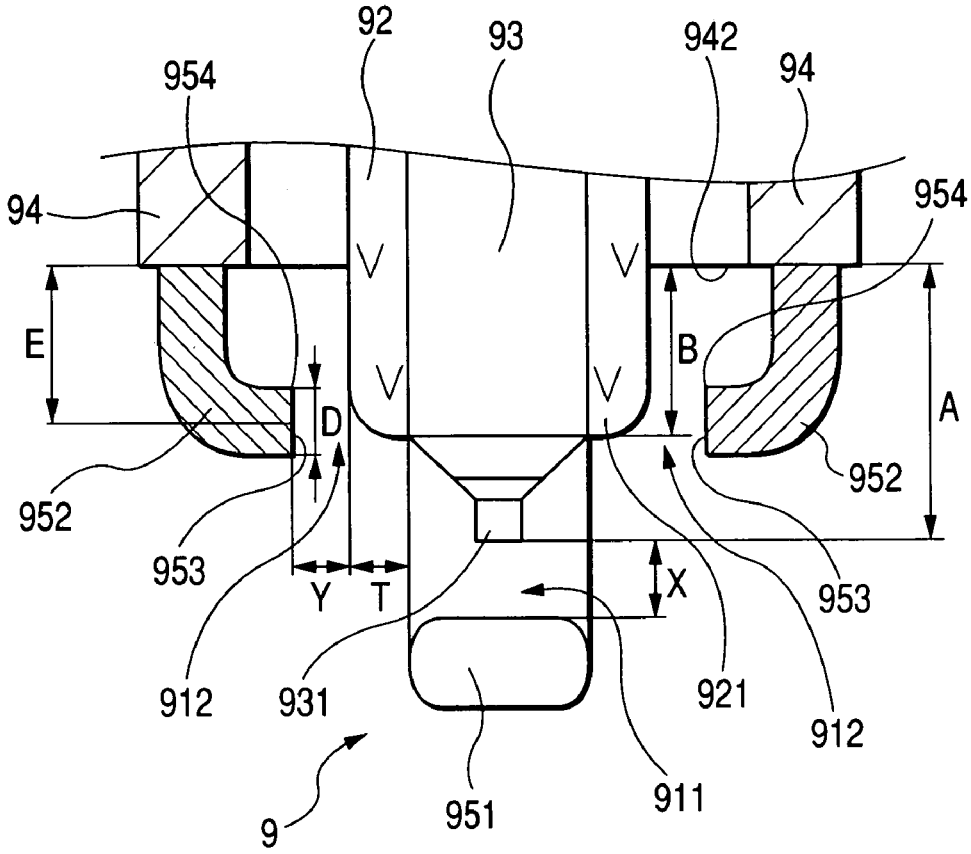
FIG. 22 PRIOR ART
FIG. 22 is a partially longitudinal sectional view which shows a top portion of a conventional spark plug.

We prepared plug samples which were identical in structure with the spark plug 1 of FIG. 1 in that the auxiliary ground electrodes 52 have the increasing-radial distance surfaces 521 and had different values of 0.5 mm, 0.7 mm, 0.9 mm, and 11.0 mm in the wall thickness T of the insulator nose 21. We also prepared comparative plug samples which were identical in structure with the prior art spark plug 9, as illustrated in FIG. 22, in that the auxiliary ground electrodes 952 have no increasing-radial distance surfaces and 1.0 mm in the wall thickness T of the insulator nose 921.

Each of the samples had the above described dimensions X=1.0 mm, Y=0.5 mm, A=4.5 mm, B=3.0 mm, E=2.8 mm, D=0.80 mm. The increasing-radial distance surface 521 was of a C-shape and had the widths a and b that were both 0.3 mm. However, in each of the comparative plug samples, the width D of the end face 953 of each of the auxiliary ground electrodes 952 was 1.1 mm, and the distance E between the top end 942 of the metal shell 94 and the center of the end face 953 of the auxiliary ground electrode 952 was 3.0 mm.

The tests were conducted using a direct injection engine in conformity to low-temperature smoldering fouling test procedures, as specified by JIS (Japanese Industrial Standards) D 1606 (Adaptability test code of spark plugs for automobiles). The evaluations of each sample were made in terms of the appearance of the insulator nose 21 (i.e., the degree to which carbon deposits are cleaned up from the insulator nose 21), the insulation resistance between the center electrode 3 and the metal shell 4, and the drivability (e.g., combustion conditions of the engine).

Results of the evaluations are demonstrated in table 1 below.

TABLE 1

| Wall Thickness T (mm) | | 0.5 | 0.7 | 0.9 | 1.0 |
|---|---|---|---|---|---|
| Carbon fouling resistance | Appearance | ○ | ○ | Δ | X |
| | Insulation Resistance | ○ | ○ | Δ | X |
| | Drivability | ○ | ○ | ○ | Δ |

In table 1, "○" indicates the plug sample which is better in one of the evaluation parameters than the comparative ones. "Δ" indicates the plug sample which is substantially equivalent to the comparative ones. "X" indicates the plug sample not better than the comparative ones.

The table 1 shows that when the wall thickness T is 0.7 mm or less, the plug samples are superior in any of the evaluation parameters to the comparative plug samples and have an enhanced carbon fouling resistance. When T=1.0 mm or 0.9 mm, an increase in difficulty in producing sparks within the auxiliary spark gaps 12 is considered to arise from the formation of the increasing-radial distance surfaces 521, so that the plug samples are not superior in the carbon fouling resistance to the comparative plug samples. It is, therefore, appreciated that when T≦0.7 mm, the carbon fouling resistance is enhanced as compared with that in the comparative plug samples.

Experiment 2

We also performed tests to evaluate the ignitability of fuel in the engine by sparks produced within the auxiliary spark gaps 12 in terms of a relation between the distance A between the top end 42 of the metal shell 4 and the tip end 311 of the center electrode 3 and the distance E between the top end 42 and the center of the constant-radial distance surface 522 of each of the auxiliary ground electrodes 52.

We prepared plug samples which were identical in structure with the spark plug 1 of FIG. 1 and in which A=4.5 mm, and B=E=3.0 mm, 2.0 mm, 1.5 mm, and 1.0 mm. Other dimensions were identical with those in the plug samples as used in the above first experiment.

The tests were conducted in conformity to low-temperature smoldering fouling test procedures, as specified by JIS D 1606. We observed the waveform of voltage of spark discharges in each sample using an oscilloscope and broken down the spark discharges into those produced in the main spark gap 11 and those produced in the auxiliary spark gaps 12. We measured a variation in combustion in the engine in which each plug sample was installed. Results of the measurement are plotted in FIG. 15.

Figure 15:
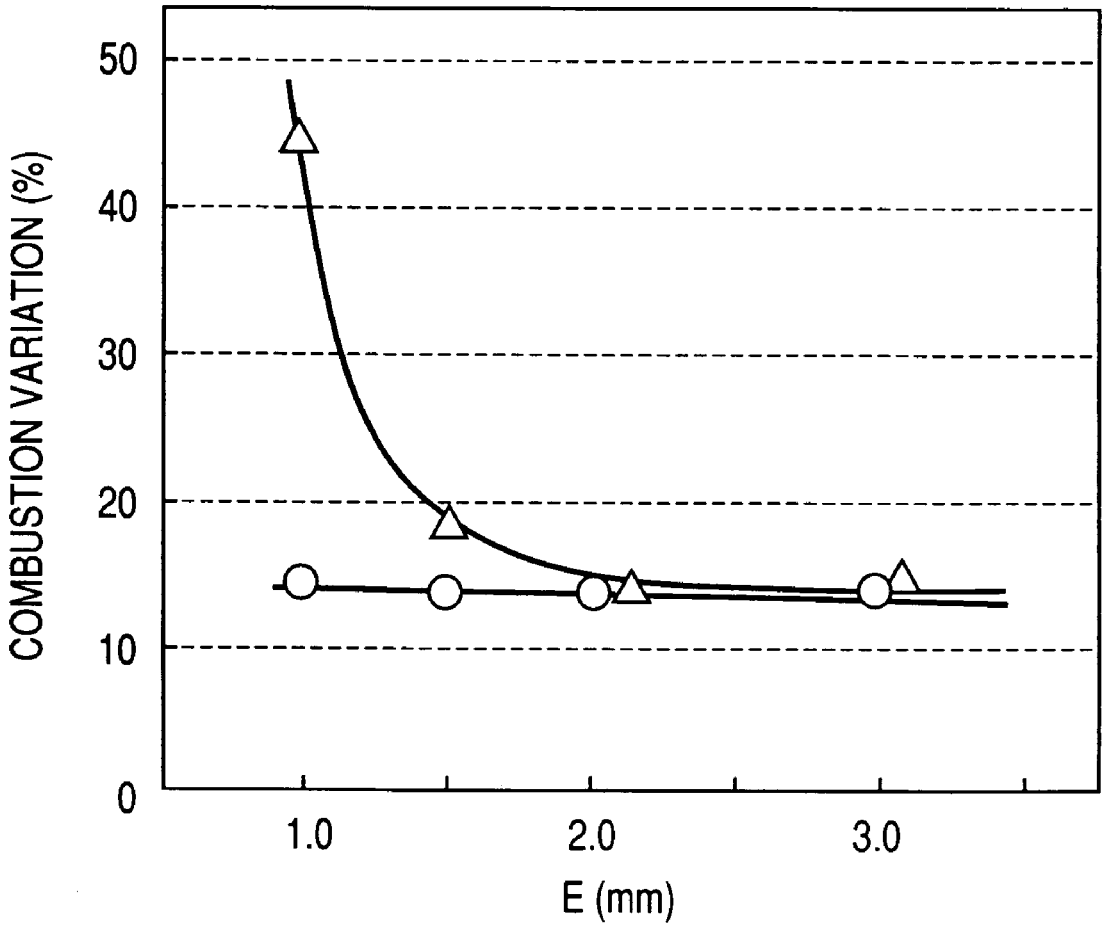
FIG. 15 is a graph which demonstrates an experimentally obtained relation between a variation in combustion of an engine and a distance E of the spark plug, as illustrated in FIG. 1.

In FIG. 15, "○" indicates the variation in combustion resulting from the spark discharges produced in the main spark gap 11. "Δ" indicates the variation in combustion resulting from the spark discharges produced in the auxiliary spark gaps 12. The variation in combustion is expressed by (standard deviation/mean effective pressure)×100.

The graph of FIG. 15 shows that when the distance E is 1.5 mm or more, that is, when A−E≦3 mm, the variations in combustion arising from the spark discharges produced in the main spark gap 11 and the auxiliary spark gaps 12 will be substantially identical with each other, and the plug samples will provide for the same ignitability of fuel.

Experiment 3

We performed tests to evaluate the carbon fouling resistance of the spark plug 1 in terms of a relation between the distance B between the top end 42 of the metal shell 4 and the top end 211 of the porcelain insulator 2 and the distance E between the top end 42 and the center of the constant-radial distance surface 522 of each of the auxiliary ground electrodes 52.

We prepared plug samples which were identical in structure with the spark plug 1 of FIG. 1 and had the same value of 4.5 m in the distance A, the same value of 3.0 mm in the distance B, and different values of 4.5 mm, 4.0 mm, 3.0 mm, 1.5 mm, and 1.0 mm in the distance E, respectively. Other dimensions were identical with those in the test samples used in the above first experiment.

We conducted the tests in conformity to the above described low-temperature smoldering fouling test procedures, as specified by JIS D 1606, and then observed the appearance of the insulator nose 21 (i.e., the degree to which carbon deposits are cleaned up from the insulator nose 21) and the insulation resistance between the center electrode 3 and the metal shell 4 in comparison with the same comparative samples as those in the above first experiment.

Results of the evaluations are demonstrated in table 2 below.

TABLE 2

| Distance E | | 1.0 | 1.5 | 3.0 | 4.0 | 4.5 |
|---|---|---|---|---|---|---|
| Carbon fouling resistance | Appearance | X | Δ | ○ | Δ | X |
| | Insulation Resistance | X | Δ | ○ | Δ | X |

In table 1, "○" indicates the plug sample which is better in one of the evaluation parameters than the comparative ones. "Δ" indicates the plug sample which is substantially equivalent to the comparative ones. "X" indicates the plug sample not better than the comparative ones.

The table 2 shows that when the distance E is 1.5 mm to 4.0 mm, the plug samples are superior in the carbon fouling resistance to the comparative plug samples, that is, that when the relation of −1.0 mm≦B−E≦1.5 mm is met, the plug samples ensure a desired degree of carbon fouling resistance.

Experiment 4

We also performed tests to measure the percentage at which sparks travel to and fly within the auxiliary spark gaps 12 of the spark plug 1 in FIG. 1 when the engine is smoldering in terms of a relation between the distance X of the main spark gap 11 and the distance Y of the auxiliary spark gaps 12.

In the tests, we run the engine at full throttle at 1200 rpm and at closed throttle cyclically to have the engine smolder intentionally to produce an insulation resistance of 10 MΩ and observed smoldering conditions of the engine. Afterwards, we run the engine at 800 rpm and measured the frequency of occurrence of sparks in the main spark gap 11 and the frequency of occurrence of sparks in the auxiliary spark gaps 12 in the same manner as that in the above second experiment. Results of the measurement are demonstrated in FIG. 16.

Figure 16:
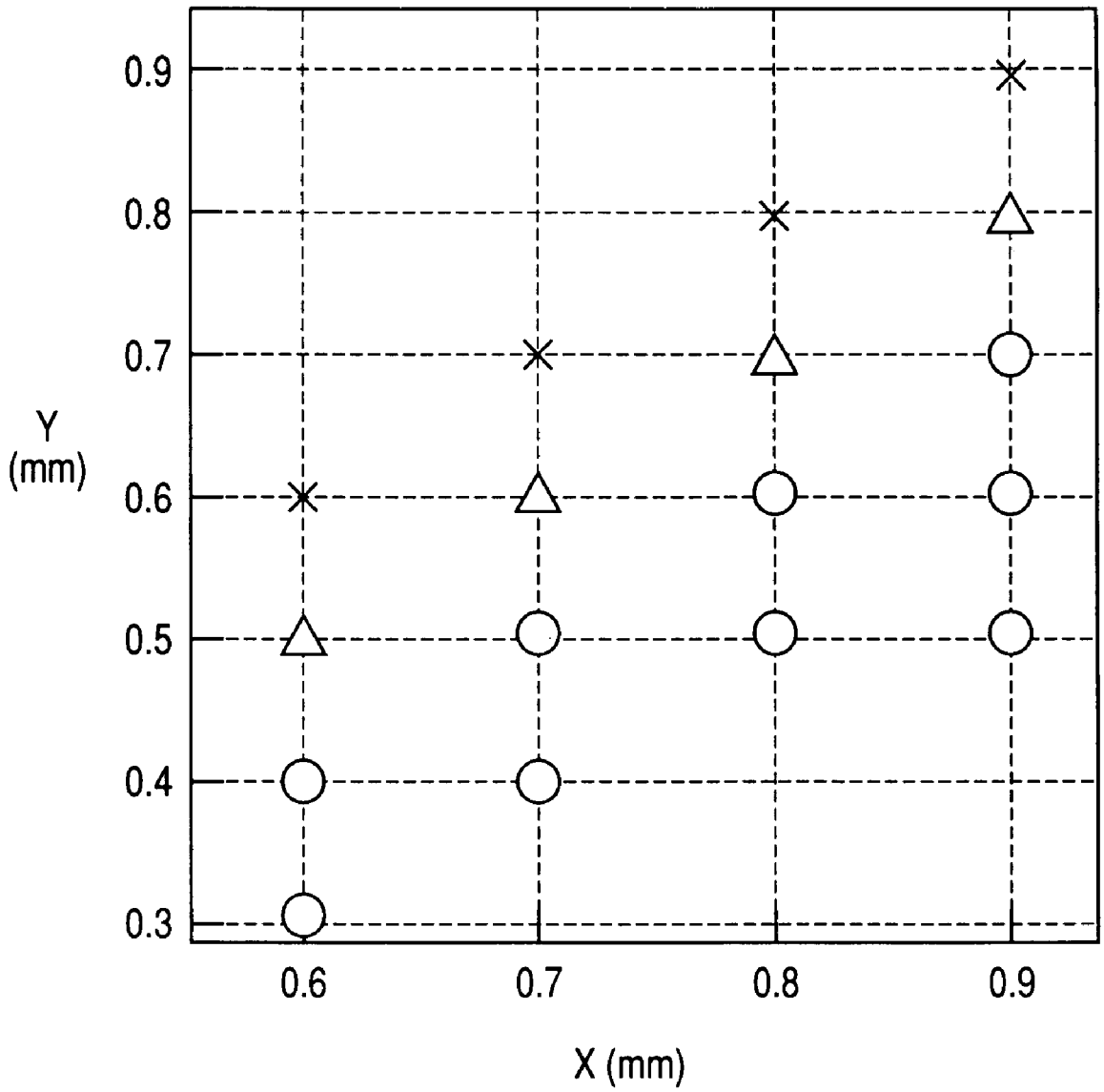
FIG. 16 is a graph which demonstrates an experimentally obtained relation between distances X and Y of the spark plug, as illustrated in FIG. 1.

In FIG. 16, "○" indicates the plug sample in which 80% or more of sparks traveled to and flied within the auxiliary spark gaps 12. "Δ" indicates the plug sample in which 50% to 80% of sparks traveled to and flied within the auxiliary spark gaps 12. "33 " indicates the plug sample in which less than 50% of sparks traveled to and flied within the auxiliary spark gaps 12.

The graph of FIG. 16 shows that when Y≦X−0.1 mm, a sequence of sparks will fly within the auxiliary spark gaps 12 at a desired percentage, and when Y≦X−0.2 mm, it results in an increased possibility of sparks flying to the auxiliary spark gaps 12.

Experiment 5

We also performed tests to observe the wear of the peripheral surface of the center electrode 3 and the channeling.

We prepared two types of plug samples: one is identical in structure with the spark plug 1 of FIG. 1, and the other is identical in structure with the prior art spark plug 9, as illustrated in FIG. 22. The plug samples had dimensions, as listed in table 3 below.

TABLE 3

| Dimension | Spark plug of the invention | Prior art spark plug |
|---|---|---|
| X | 0.9 | 1.1 |
| Y | 0.5 | 0.5 |
| T | 0.7 | 1.0 |
| A | 4.5 | 4.5 |
| B | 3.0 | 3.0 |
| E | 2.8 | 3.0 |
| D | 0.7 | 1.1 |
| a, b | 0.4 | — |

Figure 17:
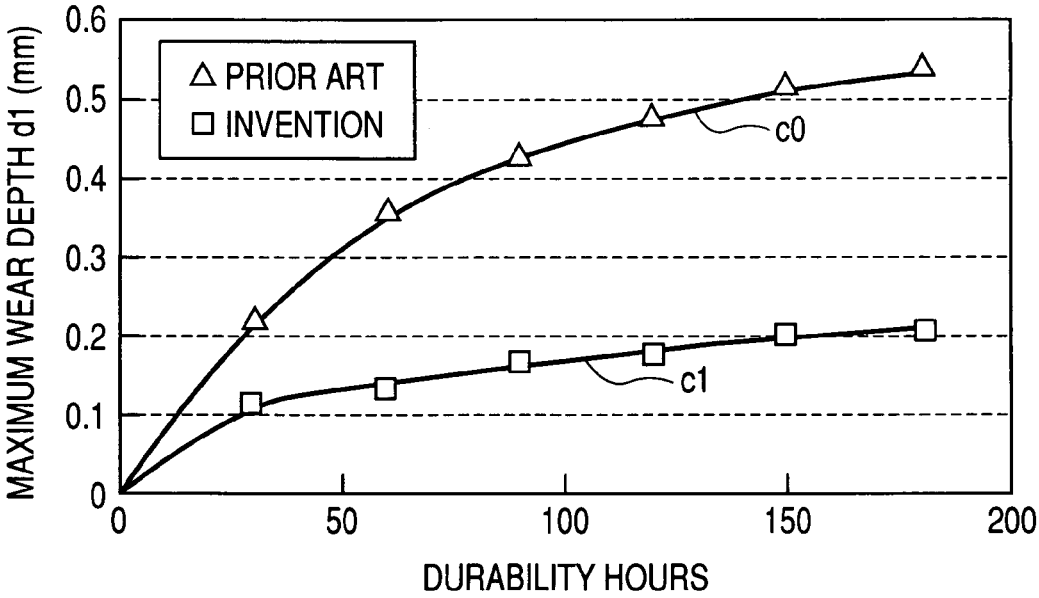
FIG. 17 is a graph which demonstrates experimentally obtained relations between a maximum wear depth d1 and durability hours in the spark plug, as illustrated in FIG. 1, and a prior art spark plug.
Figure 18:
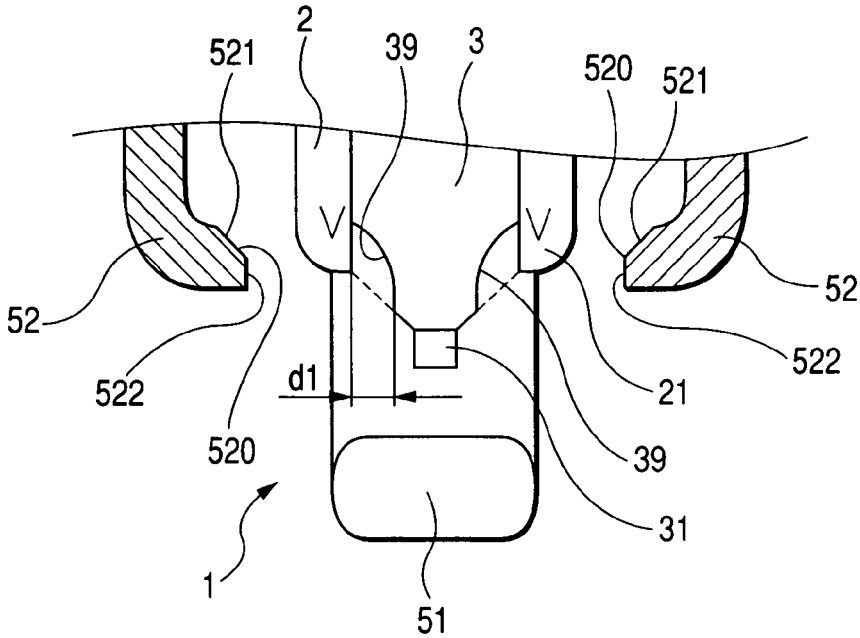
FIG. 18 is an explanatory view which shows the wear of a center electrode of a spark plug test sample.

FIG. 17 is a graph representing results of evaluation of the wear of the peripheral surface of the center electrodes 3 and 93 of the plug samples. FIG. 18 illustrates the wear of the plug samples identical in structure with the one of FIG. 1.

We conducted the tests using a 2500 cc six-cylinder high-flow rate engine equipped with a supercharger. We run the engine at full throttle at 5600 rpm to produce conditions facilitating the ease with which sparks are discharged in the auxiliary spark gaps 12 and 912 and measure a maximum wear depth d1, as illustrated in FIG. 18, every 30 hours for 180 hours. The maximum wear depth d1 is a maximum depth of a worn recess of the center electrodes 3 and 93.

In FIG. 17, a curve c0 extending through plots "Δ" indicates the wear depth of the prior art plug samples. A curve c1 extending through plots "□" indicates the wear depth of the plug samples identical in structure of the one in FIG. 1.

The graph of FIG. 17 shows that when the spark plug 1 is very small in the wear depth d1.

Figure 19:
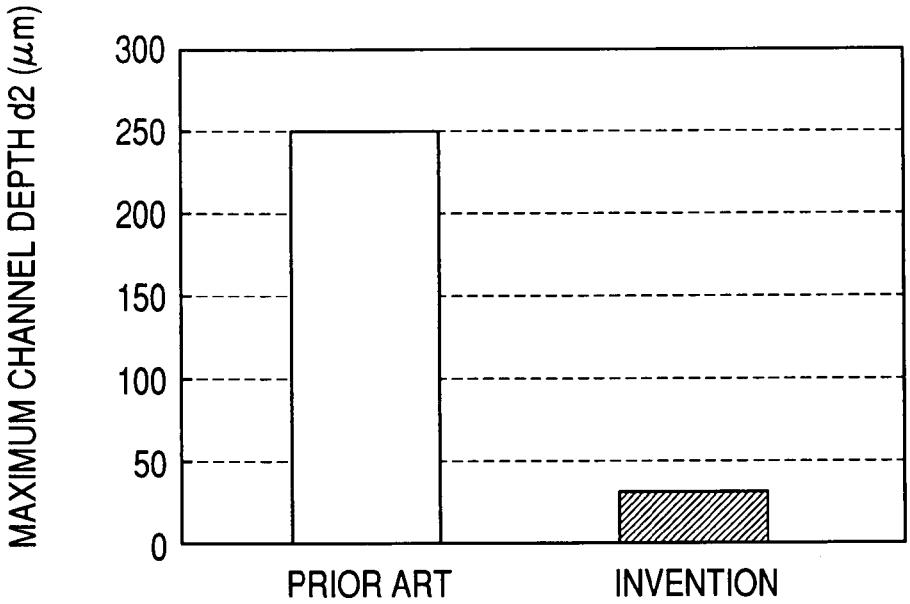
FIG. 19 is a graph which shows a comparison between depths of channels formed in center electrodes of the spark plug of FIG. 1 and a prior art spark plug.

FIG. 19 is a graph representing results of evaluation of the channeling occurring at the porcelain insulators 2 and 92 of the spark plugs 1 and 9.

Figure 20:
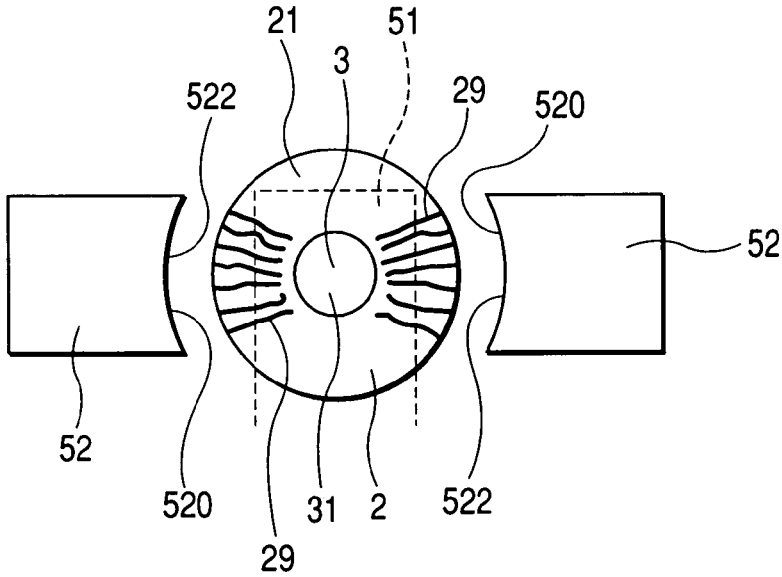
FIG. 20 is a top view which shows channels formed in a center electrode of a spark plug test sample.

We conducted the tests using a 2500 cc six-cylinder high-flow rate engine equipped with a supercharger. We run the engine at 3600 rmp at 80% throttle to induce the formation of channels 29, as illustrated in FIGS. 20 and 21, and measured a maximum depth d2 of the channels 29 after 400 hours.

Figure 21:
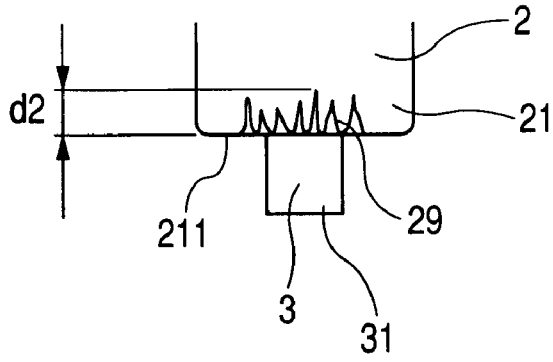
FIG. 21 is a side view of FIG. 20.

The maximum depth d2 of the channels 29 is, as clearly shown in FIG. 21, a maximum distance between the top end 211 of the insulator nose 21 and the bottom of the channels 29.

The graph of FIG. 19 shows that the spark plug 1 is very small in the depth d2 of the channels 29.

We also conducted the same tests, as described above, on plug samples identical in structure with the one of the second embodiment, as illustrated in FIGS. 5 and 6 in which the increasing-radial distance surface 521 of each of the auxiliary ground electrode 52 is rounded and found substantially the same results. The plug samples used in this experiment were 0.3 mm in the radius of curvature R of the increasing-radial distance surfaces 521 and 0.80 mm in the width D of the constant-radial distance surfaces 522.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

What is claimed is:

1. A spark plug for an internal combustion engine comprising:

a metal shell having a base end and a top end opposed to the base end in a longitudinal direction of the spark plug;

a hollow porcelain insulator having a length which includes a body and an insulator nose, the body being retained within said metal shell, the insulator nose projecting from the top end of said metal shell;

a center electrode retained within said porcelain insulator to have a top end protruding from the insulator nose;

a main ground electrode which defines a main spark gap between itself and said center electrode; and an auxiliary ground electrode having a base end, a top end opposed to the base end, and a body which has a length between the base end and the top end and is made up of a base end portion continuing to the base end and a top end portion continuing to the top end, the base end portion extending parallel to a longitudinal center line of the spark plug, the top end portion being bent from the base end portion toward the longitudinal center line of the spark plug, the base end being joined to said metal shell to extend from the top end of the metal shell and to define an auxiliary spark gap between the top end of the auxiliary ground electrode and a peripheral side surface of the insulator nose of said porcelain insulator, the top end of said auxiliary ground electrode having an end face facing the longitudinal center line of the spark plug, wherein the end face of said auxiliary ground electrode includes an increasing-radial distance surface which has a base edge closer to the base end of the auxiliary ground electrode and a top edge far from the base end of the auxiliary ground electrode and is located at a distance from the longitudinal center line of the spark plug in a radial direction of the spark plug which increases as approaching to the base edge from the top edge, and wherein the insulator nose of said porcelain insulator has a wall thickness T meeting a relation of $0.3\ \text{mm} \leqq T \leqq 0.7$ mm, and wherein the increasing-radial distance surface tapers toward the top edge thereof to have widths of 0.3 mm or more in a radius direction and the longitudinal direction of the spark plug.

2. A spark plug as set forth in claim 1, wherein the increasing-radial distance surface is rounded to have a radius of curvature of 0.3 mm or more.

3. A spark plug as set forth in claim 1, wherein a distance A between the top end of said metal shell and a top end of said center electrode in the longitudinal direction of the spark plug, a distance B between the top end of said metal shell and a top end of said porcelain insulator in the longitudinal direction of the spark plug, and a distance C between the top end of said metal shell and a portion of the end face of said auxiliary ground electrode closest to the longitudinal center line of the spark plug are selected to meet relations of $A-C \leqq 3$ mm and $-1.0\ \text{mm} \leqq B-C \leqq 1.5$ mm.

4. A spark plug as set forth in claim 1, wherein the end face of said auxiliary ground electrode also includes a constant-radial distance surface which extends farther from the top end of said metal shell than the increasing-radial distance surface in parallel to the longitudinal center line of the spark plug.

5. A spark plug as set forth in claim 4, wherein a width D of the constant-radial distance surface in the longitudinal direction of the spark plug is selected to meet a relation of $D \geqq 0.3$ mm.

6. A spark plug as set forth in claim 4, wherein a distance A between the top end of said metal shell and a top end of said center electrode in the longitudinal direction of the spark plug, a distance B between the top end of said metal shell and a top end of said porcelain insulator in the longitudinal direction of the spark plug, and a distance E between the top end of said metal shell and a center of the constant-radial distance surface of said auxiliary ground electrode in the longitudinal direction of the spark plug are selected to meet relations of $A-E \leqq 3$ mm and $-1.0$ mm $\leqq B-E \leqq 1.5$ mm.

7. A spark plug as set forth in claim 3, wherein the main spark gap has a length X, and the auxiliary spark gap has a length Y, the lengths X and Y meeting a relation of $X>Y$.

8. A spark plug as set forth in claim 6, wherein the main spark gap has a length X, and the auxiliary spark gap has a length Y, the lengths X and Y meeting a relation of $X>Y$.

9. A spark plug as set forth in claim 7, wherein the lengths X and Y also meet relations of $X \leqq 0.9$ mm and 0.3 mm $\leqq Y \leqq X-0.1$ mm.

10. A spark plug as set forth in claim 8, wherein the lengths X and Y also meet relations of $X \leqq 0.9$ mm and 0.3 mm $\leqq Y \leqq X-0.1$ mm.

11. A spark plug as set forth in claim 1, wherein said center electrode and said main ground electrode have noble metal chips opposed to each other to define the main spark gap, the noble metal chip of said center electrode having a transverse sectional area of 0.07 $mm^2$ to 0.64 $mm^2$, as extends in a direction perpendicular to the longitudinal direction of the spark plug, and a height of 0.3 mm to 1.5 mm, as extends in the longitudinal direction of the spark plug, the noble metal chip of said main ground electrode having a transverse sectional area of 0.12 $mm^2$ to 0.80 $mm^2$, as extends in a direction perpendicular to the longitudinal direction of the spark plug, and a height of 0.3 mm to 1.5 mm, as extends in the longitudinal direction of the spark plug.

12. A spark plug as set forth in claim 1, wherein said metal shell has a threaded portion formed on an outer periphery thereof which has a thread diameter of M12 or less.

* * * * *